US005116287A

United States Patent [19]

Hironaka et al.

[11] Patent Number: 5,116,287

[45] Date of Patent: May 26, 1992

[54] DECOMPRESSOR FOR INTERNAL COMBUSTION ENGINE

[75] Inventors: Yoshiaki Hironaka, Sayama; Yoshikiyo Kamata, Hachioji, both of Japan

[73] Assignee: Kioritz Corporation, Tokyo, Japan

[21] Appl. No.: 641,412

[22] Filed: Jan. 15, 1991

[30] Foreign Application Priority Data

Jan. 16, 1990 [JP] Japan ..... 2-002576[U]

[51] Int. Cl.[5] ..... F02N 3/02; F02N 17/00

[52] U.S. Cl. ..... 123/182.1; 123/185.3

[58] Field of Search ..... 123/182, 185 A, 185 B, 123/185 BA

[56] References Cited

U.S. PATENT DOCUMENTS 2,947,300 8/1960 Trapp ..... 123/182
3,687,124 8/1972 Kolorz ..... 123/185 BA

FOREIGN PATENT DOCUMENTS 55-36810 9/1980 Japan .
56-4833 3/1981 Japan .
61-35734 10/1986 Japan .

*Primary Examiner*—Andrew M. Dolinar
*Attorney, Agent, or Firm*—Browdy and Neimark

[57] ABSTRACT

A decompressor for an internal combustion engine having a decompressor valve mounted on a cylinder and a decompressor actuating lever slidably supported by guide members. A proximal end of the decompressor actuating lever is connected to a driving pawl member and a distal end of the same is closely disposed to and cooperated with a valve rod of the decompressor valve.

2 Claims, 2 Drawing Sheets

DECOMPRESSOR FOR INTERNAL COMBUSTION ENGINE

BACKGROUND OF THE INVENTION

1. Field of the Invention

The present invention relates to a so-called decompressor for an internal combustion engine drivingly connected with a Bendix-type recoil starter.

2. Description of the Related Art

Hitherto, a decompressor for an internal combustion engine has been known and used which is provided with a decompressor valve at a decompressor path communicating with either an intake path or an exhaust path and also with a combustion chamber of a cylinder of the engine. At the start-up of the engine, this decompressor valve is actuated to release pressure from the combustion chamber to the outside as a result of its driving connection with a travel of a movable member of a recoil starter at the start-up of the engine. The pressure released decreases the resistance generated by force applied to a piston when starting the engine, thereby facilitating the start-up operation of the engine. Such conventional decompressor is, however, provided with a relatively complex drivingly connecting system between the starter and the decompressor. This results in difficulty in producing a small decompressor suitable for use with an internal combustion engine such as for portable operating machines.

SUMMARY OF THE INVENTION

In order to eliminate the disadvantages of the prior art, it is an object of the present invention to provide a decompressor for an internal combustion engine which is simple and convenient in its structure. The decompressor for an internal combustion engine drivingly connected with a Bendix-type recoil starter according to this invention includes a decompressor valve mounted on a cylinder of the internal combustion engine, and a decompressor actuating lever slidably supported with guide members, wherein a proximal end of the lever is connected to a driving pawl member and a distal end of the lever is closely disposed to and cooperated with a valve rod of the decompressor valve.

Accordingly, the decompressor actuating lever actuates the valve rod and causes a cylinder chamber to communicate with the outside thereof, drivingly connected with the travel of the driving pawl member of the recoil starter at start-up of the engine. This enables the engine to readily commence operation. The construction of the decompressor is simple and compact since the opening and closing action of the decompressor valve is performed only through the decompressor actuating lever when actuating the recoil starter. In addition, the decompressor can be readily mounted on the engine without changing the construction of the conventional internal combustion engine because the cylinder is provided with a decompressor valve through which the cylinder chamber communicates with the outside.

PREFERRED EMBODIMENT OF THE INVENTION

Figure 1:
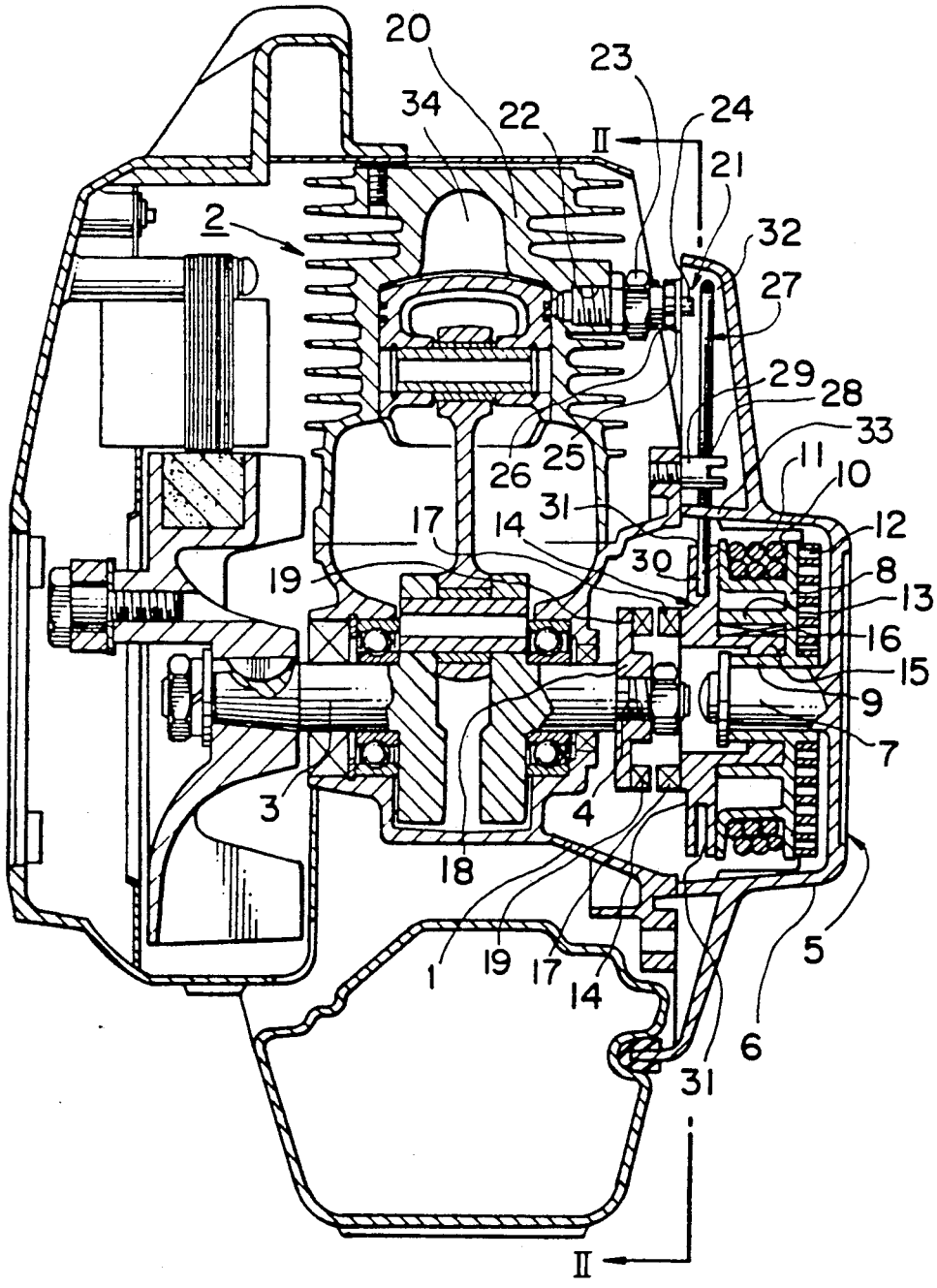
FIG. 1 is a schematic vertical sectional view of the internal combustion engine and the starter provided with the decompressor for the internal combustion engine of the present invention.
Figure 2:
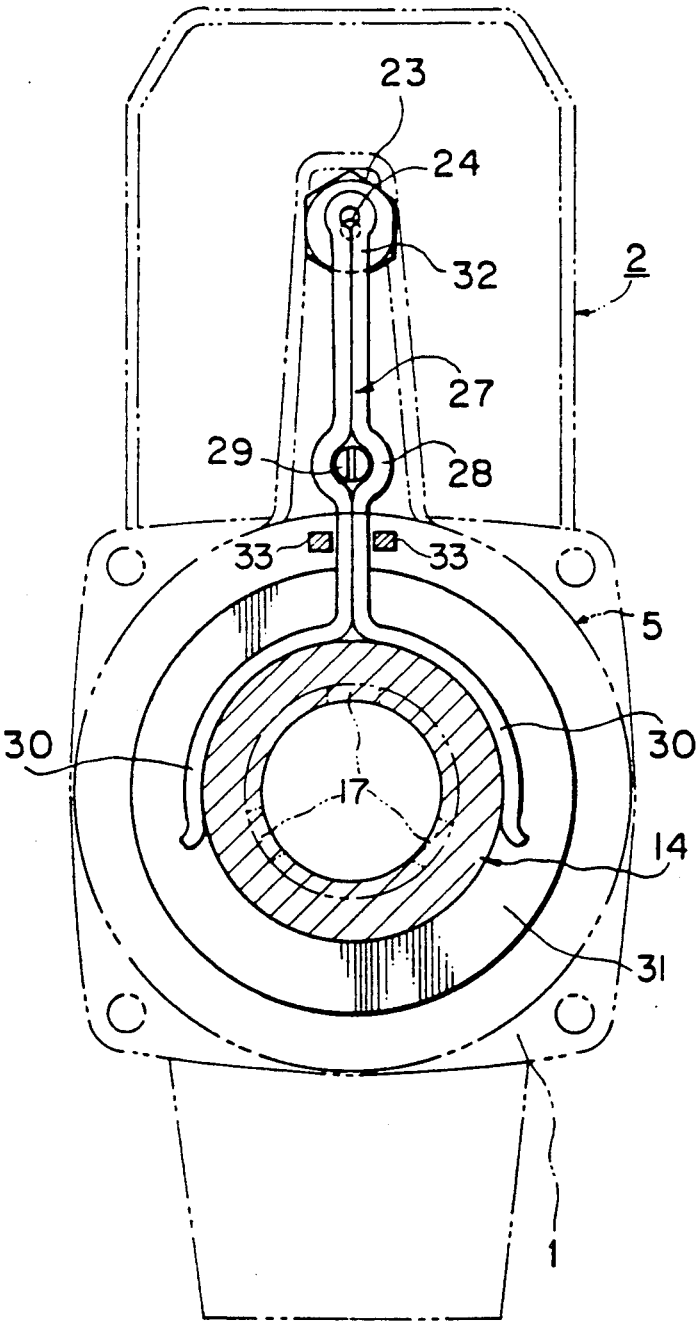
FIG. 2 is a cross section taken on line II—II in FIG. 1.

Referring now to the drawings, there is illustrated an embodiment as disclosed in the present application. The decompressor forming the subject matter of the invention is illustrated as connected to a relatively small air cooled two-cycle engine, used specifically in a portable type operating machines, such as a grass trimmer or the like. A Bendix-type recoil starter 5 is arranged in the vicinity of one end 4 of a crank shaft 3 of the internal engine 2 having an engine case 1. The starter 5 includes a starter case 6 which is mounted on the engine case 1, which starter case 6 has a shaft boss portion 7 integrally formed therewith and extending toward the one end 4 of the crank shaft 3. A boss portion 9 of a recoil drum 8 is rotatably supported on the shaft boss portion 7. The recoil drum 8 is provided with a peripheral groove 10 in which a recoil rope 11 is wound. The recoil rope 11 has its inner end secured to the recoil drum 8 and its outer end extending outward from the starter case 6 and is provided with a grip (not illustrated). A coil spring 12 is provided between the starter case 6 and the recoil drum 8, one end of the spring is engaged with the starter case 6 while the other end is engaged with recoil drum 8. The spring 12 acts to urge the recoil drum 8 toward the winding direction of the recoil drum 8. The recoil drum 8 is integrally formed with a cylindrical middle wall portion 13 having an opening toward the crank shaft 3. A boss portion 15 of a driving pawl member 14 is supported axially slidable on a peripheral surface of the boss portion 9 of the recoil drum 8.

Spiral splines are formed, respectively at the opposing surfaces of the middle wall portion 13 and the boss portion 15 of the driving pawl member 14, which spiral splines are engaged with each other at a spiral splined portion 16 provided therebetween. Such engagement enables the driving pawl member 14 to travel to the crank shaft 3 when the recoil rope 11 is pulled in an outward direction from the starter 5 at the start-up of the engine 2. The driving pawl member 14 is provided with driving pawls 17 on its surface oriented toward the crank shaft 3. A driven pawl member 18 is secured to the one end 4 of the crank shaft 3, and is provided with driven pawls 19 engagable with the driving pawls 17 at their surfaces opposite to the driving pawl member 14. The driving pawl member 14 is normally in a backward position as shown in FIG. 1, where the driving pawls 17 are spaced apart from the driven pawls 19 of the driven pawl member 18. When pulling the recoil rope 11 of the starter 5, the driving pawl member 14 travels in a forward direction, that is, a leftward direction in FIG. 1, thereby enabling the driving pawls 17 to engage with the driven pawls 19 of the driven pawl member 18.

The engine 2 includes a decompressor 21 which is secured to an upper portion of a combustion chamber 34 at the starter 5 side of a cylinder 20. The decompressor 21 has a decompressor valve 23 attached to a hole 22 which horizontally passes through the cylinder 20. The decompressor valve 23 includes a valve rod 24 formed inside thereof which opens or closes a valve path (not illustrated) communicating inside and outside of the combustion chamber 34 of the cylinder 20. The outer end of the valve rod 24 is disposed to an interior side of the starter case 6 such that fuel and others from the combustion chamber 34 are prevented from scattering outside. The valve rod 24 is urged toward the outside by a compression coil spring 26 which is provided between a flanged member 25 at the outer end of the valve rod 24 and the decompressor valve 23. This spring 26 always causes the valve rod 24 to close the valve path in the decompressor valve 23. The decompressor 21 has a decompressor actuating lever 27 made of a bended steel rod. This decompressor actuating level 27 is slidably supported on a guide pin 29 at its hole portion 28 located in a middle portion thereof and is disposed inside of the starter case 6, which guide pin 29 is secured to the engine case 1 and is extended to the interior side of the starter case 6. The decompressor actuating lever 27 is formed in a generally semicircular bifurcated shape at its proximal end 30. This proximal end 30 is inserted into a peripheral groove 31 formed in the driving pawl member 14 of the starter 5, whereby this end 30 is suitably held in place and engaged with the driving pawl member 14. A distal end 32 of the decompressor actuating lever 27 is closely disposed to the outer end of the valve rod 24 of the decompressor valve 23 and is slightly spaced apart from the outer end of the valve rod 24 of the decompressor valve 23 when the driving pawl member 14 of the starter 5 is in the backward position. When the driving pawl member 14 travels to the forward position in starting the engine 2, the decompressor actuating lever 27 travels together with the driving pawl member 14 while preventing an oscillation with the guide pin 29 and a guide portion 33, thereby enabling the distal end 32 to contact the outer end of the valve rod 24 of the decompressor valve 23. Then, the decompressor actuating lever 27 causes the valve rod 24 to travel to leftward direction in FIG. 1, against the force generated by the spring 26, enabling the valve path of the decompressor valve 23 to open and the combustion chamber 34 of the cylinder 20 to communicate with outside thereof, thereby facilitating commencing operation of the engine.

The decompressor actuating lever 27 definitely moves forward and backward while being guided by the guide pin 29 and the guide portion 33, and also provides the driving pawl member 14 with a suitable control action toward a rotational movement, thereby enabling the Bendix-type recoil starter 5 to commence operation securely.

What is claimed is:

1. A decompressor for an internal combustion engine drivingly connected with a Bendix-type recoil starter comprising, a decompressor valve mounted on a cylinder of said internal combustion engine and a decompressor actuating lever slidably supported by guide members, wherein a proximal end of said lever is inserted into a peripheral groove formed in a driving pawl member of said recoil starter, said actuating lever being laterally moved over its entire length with said driving pawl member when starting said engine and a distal end of said lever is closely disposed to and cooperates with a valve rod of said decompressor valve to open said valve.

2. A decompressor as claimed in claim 1, wherein said decompressor actuating lever is provide with a hole portion at a middle portion thereof and a generally semicircular bifurcated portion at the proximal end thereof.

* * * * *